US011173721B2

(12) United States Patent
Takahashi et al.

(10) Patent No.: US 11,173,721 B2
(45) Date of Patent: Nov. 16, 2021

(54) LIQUID DISCHARGE APPARATUS AND METHOD FOR DISCHARGING LIQUID

(71) Applicant: Brother Kogyo Kabushiki Kaisha, Nagoya (JP)

(72) Inventors: Yuki Takahashi, Nagoya (JP); Hirotoshi Ishizaki, Nagakute (JP); Motohiro Tsuboi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/828,284

(22) Filed: Mar. 24, 2020

(65) Prior Publication Data

US 2020/0307243 A1 Oct. 1, 2020

(30) Foreign Application Priority Data

Mar. 29, 2019 (JP) ..... JP2019-065810
Feb. 18, 2020 (JP) ..... JP2020-025008

(51) Int. Cl.
*B41J 2/175* (2006.01)
*B41J 2/185* (2006.01)
*B41J 2/18* (2006.01)

(52) U.S. Cl.
CPC ..... *B41J 2/17596* (2013.01); *B41J 2/17523* (2013.01); *B41J 2/17556* (2013.01); *B41J 2/17566* (2013.01); *B41J 2/18* (2013.01); *B41J 2/185* (2013.01)

(58) Field of Classification Search
CPC .... B41J 2/175; B41J 2/17523; B41J 2/17556; B41J 2/17566; B41J 2/17596; B41J 2/18; B41J 2/185
See application file for complete search history.

(56) References Cited

U.S. PATENT DOCUMENTS 5,231,424 A * 7/1993 Kaneko ..... B41J 2/16508 347/29
5,481,284 A 1/1996 Kitahara et al.
7,416,288 B2 * 8/2008 Takatsuka ..... B41J 2/18 347/85
7,874,636 B2 * 1/2011 Perrin ..... B41J 2/16552 347/28
8,449,087 B2 * 5/2013 Kataoka ..... B41J 2/175 347/84
8,579,422 B2 11/2013 Matsuoka et al.
(Continued)

FOREIGN PATENT DOCUMENTS

EP 2468512 B1 7/2014
EP 2588323 B1 3/2015
EP 2516167 B1 7/2015
(Continued)

OTHER PUBLICATIONS

Sep. 8, 2020—(EP) Extended Search Report—App 20165011.6.

*Primary Examiner* — Anh T Vo
(74) *Attorney, Agent, or Firm* — Banner & Witcoff, Ltd.

(57) ABSTRACT

There is provided a liquid discharge apparatus including: a head unit including: at least one liquid discharge head; a fill tank; and a drain tank. The liquid discharge apparatus further includes: a main tank; a pump; a first flow passage; a second flow passage; a third flow passage; a fourth flow passage; a fifth flow passage; a first valve; a second valve; a third valve; a fourth valve; and a fifth valve.

17 Claims, 9 Drawing Sheets

(56) References Cited

U.S. PATENT DOCUMENTS

| | | | | |
|---|---|---|---|---|
| 10,124,597 | B2 * | 11/2018 | Alessi | B41J 2/175 |
| 2012/0188316 | A1 | 7/2012 | Matsuoka et al. | |

FOREIGN PATENT DOCUMENTS

| | | | |
|---|---|---|---|
| JP | H06-183029 | A | 7/1994 |
| JP | 2003-266745 | A | 9/2003 |
| JP | 2012-000819 | A | 1/2012 |
| JP | 2012-152972 | A | 8/2012 |
| JP | 2018-165014 | A | 10/2018 |
| WO | 2016-208533 | A1 | 12/2016 |

* cited by examiner

LIQUID DISCHARGE APPARATUS AND METHOD FOR DISCHARGING LIQUID

CROSS REFERENCE TO RELATED APPLICATION

The present application claims priorities from Japanese Patent Application No. 2019-065810 filed on Mar. 29, 2019 and Japanese Patent Application No. 2020-025008 filed on Feb. 18, 2020, the disclosures of which are incorporated herein by reference in their entirety.

BACKGROUND

Field of the Invention

The present invention relates to a liquid discharge apparatus for discharging a liquid such as an ink or the like, and a method for discharging a liquid by using the liquid discharge apparatus.

Description of the Related Art

There is known a printer which is provided with one pump, an ink discharge head, a tank (fill tank) for supplying an ink to the ink discharge head, a tank (drain tank) for recovering the ink allowed to flow from the ink discharge head, and a main tank for supplying the ink to the fill tank. In this printer, the two tanks are connected to one another by the aid of the pump. In this printer, the ink, which is contained in the drain tank, is transported toward the fill tank by using the pump. Thus, the ink is circulated through the fill tank, the ink discharge head, and the drain tank. Then, when the printing is performed, the ink is discharged from the ink discharge head, while circulating the ink through the two tanks and the ink discharge head.

SUMMARY

When the printing is performed, the high duty printing, in which the ink discharge amount per unit time is large, is performed in some cases. In the high duty printing, the ink is discharged from the ink discharge head at a speed which is not less than the ink supply speed from the fill tank. In this case, the ink is also supplied to the ink discharge head not only from the fill tank but also from the drain tank. In such a situation, the ink contained in the drain tank is decreased. Therefore, finally, the ink cannot be supplied to the ink discharge head in some cases. On this account, it is desirable that the ink can be also supplied from the main tank to the drain tank. However, in the case of the printer described above, the ink can be supplied from the main tank to the fill tank, but the ink cannot be supplied to the drain tank.

Further, as described later on, there are inks for which it is preferable to circulate the ink in the ink flow passage including the main tank without being limited to only the portion between the fill tank and the drain tank, and inks for which it is enough to circulate the ink only between the fill tank and the drain tank without allowing the ink to flow through the main tank, depending on the type of the ink. The cost becomes expensive if ink flow passages, which are distinct from each other, are designed depending on whether or not the ink is circulated in the flow passage including the main tank. Therefore, it is desired that the switching can be performed for whether or not the ink is circulated in the ink flow passage including the main tank by using an identical configuration of the ink flow passage. Further, as for the members for constructing the ink flow passage, the pump is a relatively expensive member. Therefore, it is desired that one pump is used.

The present disclosure has been made taking the foregoing circumstances into consideration, an object of which is to provide a printer which makes it possible to supply an ink from a main tank to both of a fill tank and a drain tank by means of one pump and which makes it possible to switch the circulation of the ink between the fill tank and the drain tank without using the main tank and the circulation of the ink in a flow passage including the main tank as well without being limited to only the portion between the fill tank and the drain tank.

According to an aspect of the present disclosure, there is provided a liquid discharge apparatus configured to discharge a liquid onto a medium, including: a head unit including: at least one liquid discharge head; a fill tank configured to store the liquid to be supplied to the at least one liquid discharge head; and a drain tank configured to store the liquid recovered from the at least one liquid discharge head. The liquid discharge apparatus further includes: a main tank configured to store the liquid to be supplied to the head unit; a pump including an inlet and an outlet and configured to feed the liquid from the inlet to the outlet; a first flow passage including a first end connected to the main tank and a second end connected to the inlet of the pump; a second flow passage including a first end connected to the outlet of the pump and a second end connected to the fill tank; a third flow passage including a first end connected to a first branch point as a branch point for branching the second flow passage and a second end connected to the drain tank; a fourth flow passage including a first end connected to a second branch point as a branch point for branching the first flow passage and a second end connected to a third branch point as a branch point for branching the third flow passage; a fifth flow passage including a first end connected to the main tank and a second end connected to a fourth branch point as a branch point for branching the second flow passage between the first end of the second flow passage and the first branch point; a first valve arranged at a portion of the first flow passage disposed between the first end of the first flow passage and the second branch point; a second valve arranged at a portion of the second flow passage disposed between the first branch point and the second end of the second flow passage; a third valve arranged at a portion of the third flow passage disposed between the first end of the third flow passage and the third branch point; a fourth valve arranged at a portion of the fourth flow passage disposed between the first end of the fourth flow passage and the second end of the fourth flow passage; and a fifth valve arranged at a portion of the fifth flow passage disposed between the first end of the fifth flow passage and the second end of the fifth flow passage.

According to the configuration described above, one pump can be used to execute the supply of the liquid from the main tank to the drain tank, the supply of the liquid from the main tank to the fill tank, and the concurrent supply of the liquid from the main tank to the drain tank and the fill tank. Accordingly, one pump can be used to singly or concurrently supply the liquid from the main tank to both of the drain tank and the fill tank. Further, one pump can be used to execute not only the circulation of the liquid from the drain tank to the fill tank but also the transport of the liquid from the drain tank to the main tank and the circulation of the liquid so that the liquid allowed to outgo from the main tank is returned to the main tank again. For example, the liquid can be transported from the drain tank to the main tank, and then the liquid can be supplied from the main tank to the drain tank. Further, the liquid can be circulated from the drain tank to the fill tank. Accordingly, the liquid can be circulated from the drain tank to the fill tank through the flow passage including the main tank.

DESCRIPTION OF THE EMBODIMENTS

A printer 1 according to an embodiment of the present disclosure will be explained on the basis of the drawings.

Figure 1:
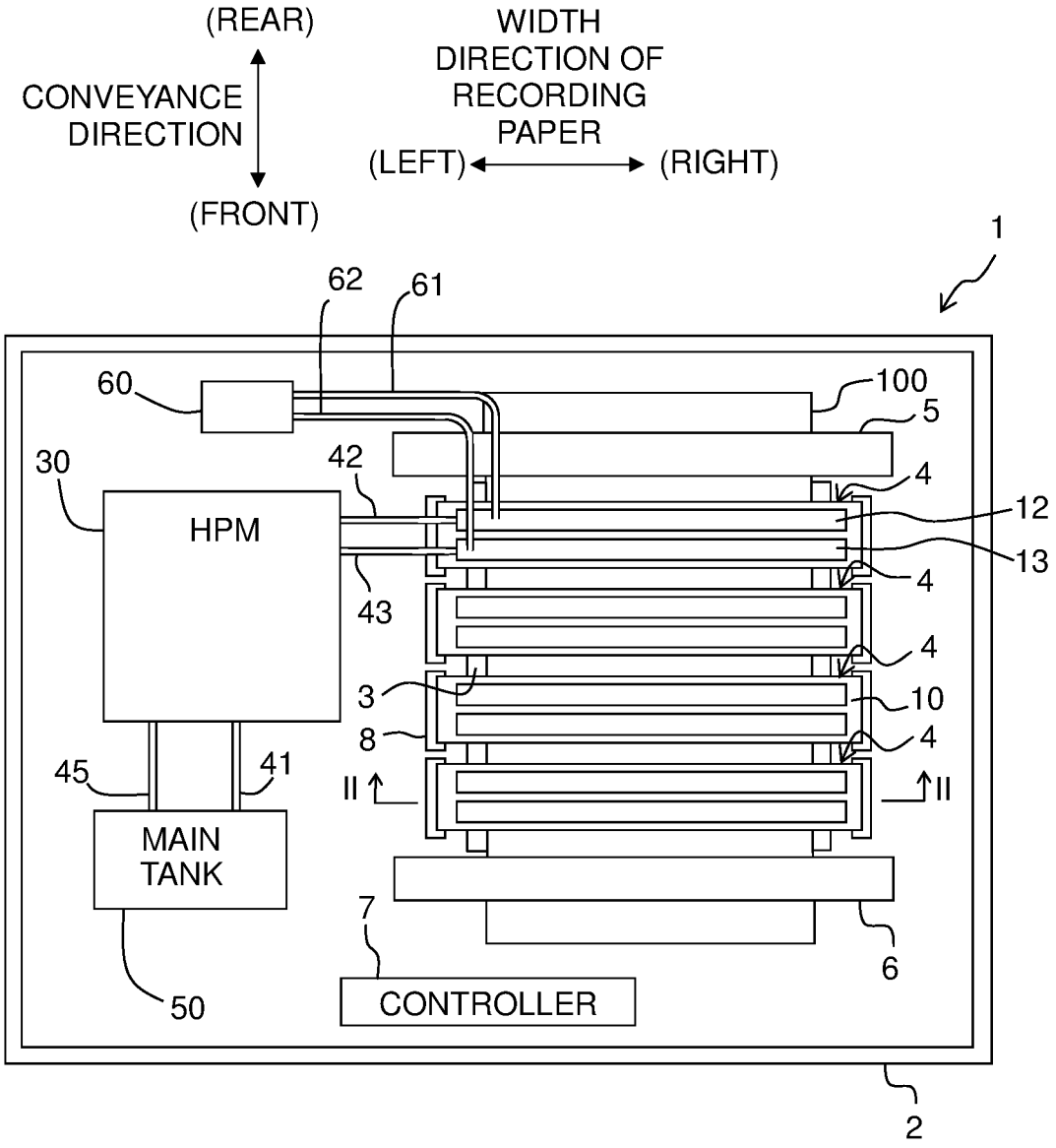
FIG. 1 schematically depicts a printer 1.

As depicted in FIG. 1, the downstream side (lower side in FIG. 1) in the conveyance direction of the recording paper 100 is defined as the forward of the printer 1, and the upstream side (upper side in FIG. 1) in the conveyance direction is defined as the backward of the printer 1. Further, the widthwise direction of the recording paper, which is parallel to the plane (plane parallel to the paper surface of FIG. 1) for conveying the recording paper 100 and which is orthogonal to the conveyance direction, is defined as the left-right direction of the printer 1. Note that the left side of FIG. 1 corresponds to the leftward of the printer 1, and the right side of FIG. 1 corresponds to the rightward of the printer 1. Further, the direction (direction orthogonal to the paper surface of FIG. 1), which is orthogonal to the transport surface of the recording paper 100, is defined as the upward-downward direction of the printer 1. In FIG. 1, the front side of the recording paper 100 corresponds to the upward, and the back side of the recording paper 100 corresponds to the downward.

As depicted in FIG. 1, the printer 1 is provided with a casing 2, a platen 3, four ink-jet head bars 4 (hereinafter referred to as "head bars"), two transport rollers 5, 6, a controller 7, four HPM's 30, four main tanks 50, and four air pressure regulators 60. Four HPM's 30, the four main tanks 50, and the four air pressure regulators 60 correspond to the four head bars 4 respectively. Note that HPM is an abbreviation of "Hydraulic Pneumatics Module" which is a kind of the flow passage switching mechanism for switching the flow passage for allowing the ink to pass therethrough, by appropriately combining five flow passages by opening/closing five valves as described later on. In FIG. 1, only the main tank 50, HPM 30, and the air pressure regulator 60, which correspond to one head bar 4 of the four head bars 4, are depicted in FIG. 1 in order to view the drawing more easily or comprehensively.

The platen 3 is arranged at the inside of the casing 2. The recording paper 100, which is transported by any one of the two transport rollers 5, 6, is supported by the platen 3 on its upper surface. The four head bars 4 are arranged over the platen 3 in a state in which the four head bars 4 are aligned in the front-back direction respectively. The two transport rollers 5, 6 are arranged on the back side and the front side with respect to the platen 3 respectively. The two transport rollers 5, 6 are driven by an unillustrated motor respectively. The two transport rollers 5, 6 frontwardly transport the recording paper 100 on the platen 3 by means of the motor.

The controller 7 is provided with, for example, ROM (Read Only Memory), RAM (Random Access Memory), and ASIC (Application Specific Integrated Circuit) including various control circuits. The controller 7 is connected to an unillustrated external apparatus such as PC or the like in a wired or wireless manner so that the data communication can be performed. The controller 7 executes various processes including, for example, the printing on the recording paper 100 by means of ASIC in accordance with programs stored in ROM on the basis of the printing data transmitted from the external apparatus.

For example, the controller 7 controls the unillustrated motor for driving the two transport rollers 5, 6 so that the recording paper 100 is transported in the conveyance direction by means of the transport rollers 5, 6. Further, the controller 7 controls the head bars 4 to discharge the ink toward the recording paper 100 during the period in which the recording paper 100 is transported by the two transport rollers 5, 6. Accordingly, an image is printed on the recording paper 100. Further, as described later on, the controller 7 controls HPM 30 and the air pressure regulator 60 to control, for example, the supply of the ink from the main tank 50 to the head bar 4, the recovery of the ink from the head bar 4 to the main tank 50, and the circulation of the ink between the main tank 50 and the head bar 4.

Four head bar holders 8 are arranged on the casing 2. The four head bar holders 8 are arranged over the platen 3 between the two transport rollers 5, 6 in the conveyance direction. Each of the head bar holders 8 holds one head bar 4.

The four head bars 4 discharge the four color inks of cyan (C), magenta (M), yellow (Y), and black (K) respectively. The ink having the corresponding color is supplied to each of the head bars 4 from the main tank 50.

Figure 2:
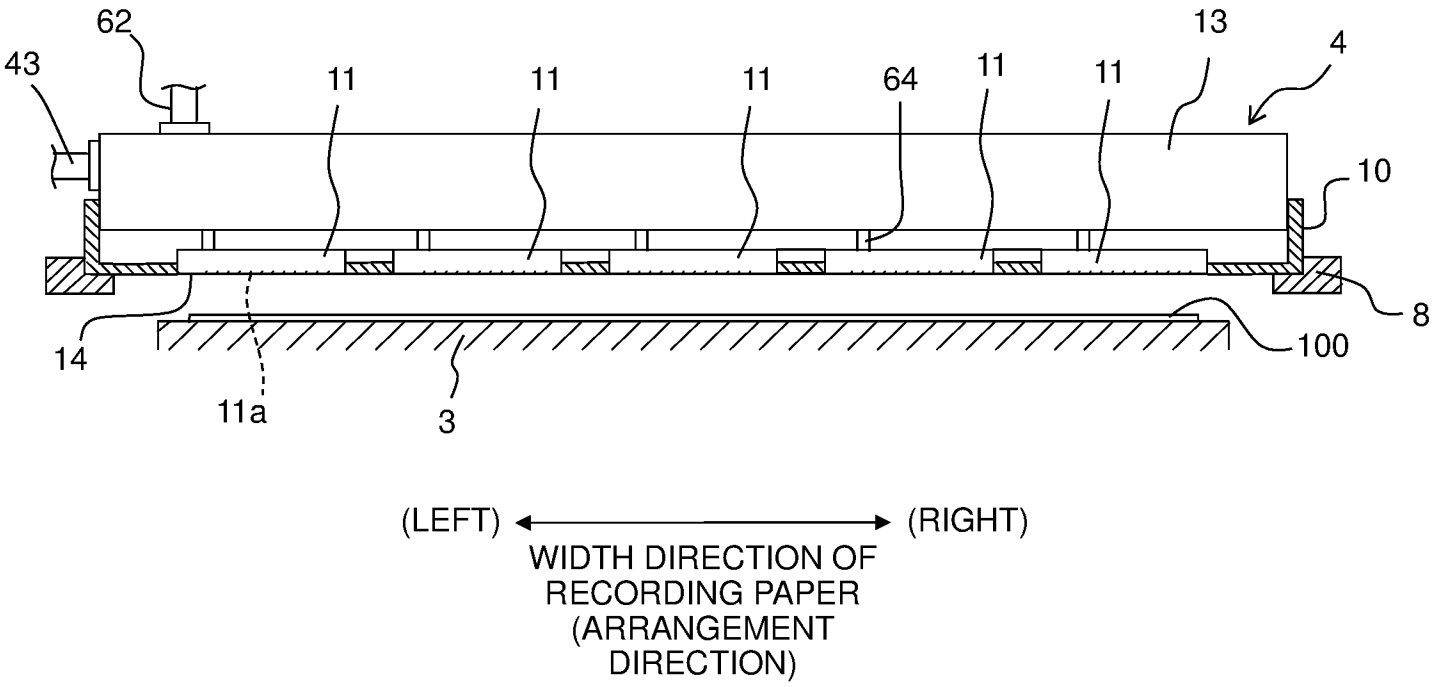
FIG. 2 schematically depicts a sectional view taken along a cutting plane line of II-II line depicted in FIG. 1.
Figure 3:
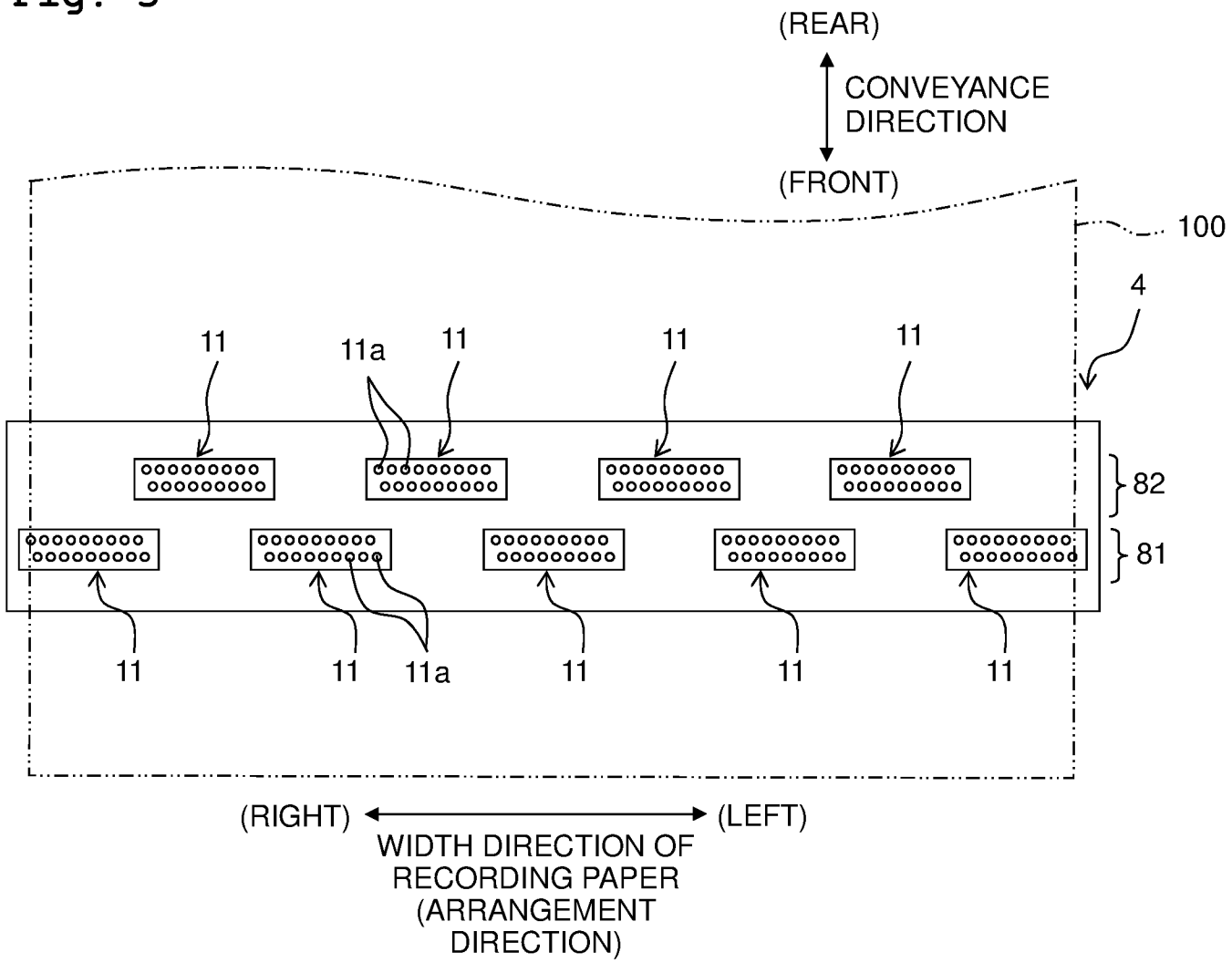
FIG. 3 depicts a bottom view illustrating an ink-jet head bar 4.

As depicted in FIG. 3, each of the head bars 4 is provided with a holder 10 (see FIG. 2) and nine heads 11. The holder 10 has a rectangular plate-shaped configuration which is long in the widthwise direction of the recording paper. Further, the holder 10 retains the nine heads 11. Further, the head bar 4 has a fill tank 12 and a drain tank 13 as described later on to perform the supply of the ink to the respective heads 11 and the recovery of the ink.

<Head 11>

As depicted in FIG. 3, a plurality of nozzles 11*a* are formed on the lower surface of each of the heads 11. The plurality of nozzles 11*a* of the head 11 are formed in the widthwise direction of the recording paper which is the longitudinal direction of the head bar 4. The plurality of heads 11 are mutually arranged in a zigzag form in the conveyance direction and the widthwise direction of the recording paper (arrangement direction).

In the following description, the plurality of heads 11, which are arranged on the backward side in the conveyance direction (upstream side in the conveyance direction), are designated as "first head array 81". Further, the plurality of heads 11, which are arranged on the forward side in the conveyance direction (downstream side in the conveyance direction), are designated as "second head array 82". As depicted in FIG. 3, left end portions of the head 11 of the first head array 81 are disposed at approximately the same positions as those of right end portions of the heads 11 of the second head array 32 in the left-right direction. The heads 11 are electrically connected to the controller 7.

<Fill Tank 12 and Drain Tank 13>

As depicted in FIG. 1, the fill tank 12 and the drain tank 13 are arranged respectively over each of the heads 11. The fill tank 12 has approximately the same shape as that of the drain tank 13. The fill tank 12 is connected to the heads 11 by the aid of a tube 63 (see FIGS. 4 to 9). The drain tank 13 is connected to the heads 11 by the aid of a tube 64 (see FIGS. 2 and 4 to 9). Note that in FIGS. 4 to 9, such a situation is exemplarily depicted that the fill tank 12 and the drain tank 13 are connected to one of the heads 11 by the aid of the tubes 63, 64. However, actually, the fill tank 12 and the drain tank 13 are connected to the nine heads 11 by the aid of the tubes 63, 64. Note that the nine heads 11 are arranged in parallel.

As depicted in FIGS. 4 to 9, the fill tank 12 is connected to the air pressure regulator 60 by the aid of the tube 61, and the drain tank 13 is connected to the air pressure regulator 60 by the aid of the tube 62. The air pressure regulator 60 regulates or adjusts the air pressures in the fill tank 12 and the drain tank 13 respectively to generate the differential pressure between the fill tank 12 and the drain tank 13. In this embodiment, the air pressure regulator 60 regulates the internal pressures of the fill tank 12 and the drain tank 13 so that the internal pressure of the fill tank 12 is higher than the pressure of the drain tank 13. The flow of the ink, which is directed from the fill tank 12 via the heads 11 to the drain tank 13, can be generated by generating the differential pressure between the fill tank 12 and the drain tank 13. In this specification, the flow of the ink as described above is referred to as "differential pressure circulation" between the fill tank 12 and the drain tank 13.

Further, as depicted in FIGS. 4 to 9, the fill tank 12 is connected to a second flow passage 42 of HPM 30 as described later on, and the drain tank 13 is connected to a third flow passage 43 of HPM 30 as described later on.

Sensors S1, S2 for detecting the ink amounts in the tanks are arranged at the inside of the fill tank 12 and the drain tank 13 respectively. Known liquid amount sensors can be used as the sensors S1, S2. In this embodiment, float sensors, which detect the heights of the liquid surfaces of the inks by using floats, are provided as the sensors S1, S2. The sensors S1, S2 output first output signals to indicate that the ink amounts are the full amounts when the ink amounts exceed predetermined first threshold values, while the sensors S1, S2 output second output signals to indicate that the ink amounts approach zero when the ink amounts are lower than predetermined second threshold values. The controller 7 can detect the ink amounts of the fill tank 12 and the drain tank 13 in accordance with the first output signal and the second output signal of the sensors S1, S2. Note that the sensors S1, S2 may output the output signals which continuously change depending on the heights of the liquid surfaces of the inks.

<HPM 30>

As depicted in FIGS. 4 to 9, HPM 30 is mainly provided with a pump 32, a deaeration unit 34, five flow passages (first flow passage 41 to fifth flow passage 45), and five valves V1 to V5. The valve V1 is arranged in the first flow passage 41, and the valve V1 opens/closes the first flow passage 41. The valve V2 is arranged in the second flow passage 42, and the valve V2 opens/closes the second flow passage 41. The valve V3 is arranged in the third flow passage 43, and the valve V3 opens/closes the third flow passage 43. The valve V4 is arranged in the fourth flow passage 44, and the valve V4 opens/closes the fourth flow passage 44. The valve V5 is arranged in the fifth flow passage 45, and the valve V5 opens/closes the fifth flow passage 45. The opening/closing operations of the valves V1 to V5 can be controlled by the controller 7.

The pump 32 has a suction port 32A and a discharge port 32B. The ink, which is sucked from the suction port 32A, is extruded from the discharge port 33B. Accordingly, the flow of the ink, which is directed from the suction port 32A to the discharge port 32B, is generated. The deaeration unit 34 is a known deaeration module which removes the gas such as the air or the like contained in the ink allowed to pass through the deaeration unit 34. In this embodiment, the deaeration unit 34 is arranged on the downstream side (in the second flow passage 42) of the discharge port 32B of the pump 32.

As depicted in FIGS. 4 to 9, one end 41*a* of the first flow passage 41 is connected to the main tank 50, and the other end 41*b* is connected to the suction port 32A of the pump 32. The valve V1 is arranged between one end 41*a* and the other end 41*b* of the first flow passage 41.

One end 42*a* of the second flow passage 42 is connected to the discharge port 32B of the pump 32, and the other end 42*b* is connected to the fill tank 12. The valve V2 is arranged between one end 42*a* and the other end 42*b* of the second flow passage 42. The deaeration unit 34 is arranged between the valve V2 and one end 42*a*.

One end 43*a* of the third flow passage 43 is connected to a branch point J1 disposed between the deaeration unit 34 and the valve V2 of the second flow passage 42, and the other end 43*b* is connected to the drain tank 13. In this way, the third flow passage 43 is a flow passage which is branched from the branch point J1 of the second flow passage 42. The valve V3 is arranged between one end 43*a* and the other end 43*b* of the third flow passage 43.

One end 44*a* of the fourth flow passage 44 is connected to a branch point J2 disposed between the valve V1 and the second end 41*b* of the first flow passage 41, and the other end 44*b* is connected to a branch point J3 disposed between the valve V3 and the second end 43*b* of the third flow passage 43. In this way, the fourth flow passage 44 is a flow passage which is branched from the branch point J2 of the first flow passage 41, and the fourth flow passage 44 is also a flow passage which is branched from the third branch point J3 of the third flow passage 43. The valve V4 is arranged between one end 44*a* and the other end 44*b* of the fourth flow passage 44.

One end 45*a* of the fifth flow passage 45 is connected to the main tank 50, and the other end 45*b* is connected to a branch point J4 disposed between the discharge port 32B of the pump 32 of the second flow passage 43 and the deaeration unit 34. In this way, the fifth flow passage 45 is a flow passage which is branched from the branch point J4 of the second flow passage 42. The valve V5 is arranged between one end 45*a* and the other end 45*b* of the fifth flow passage 45.

<Ink Flow Passage Control>

In this embodiment, the control of the flow of the ink, which includes, for example, (1) the circulation of the ink from the drain tank 13 to the fill tank 12, (2) the supply of the ink from the main tank 50 to the drain tank 13, (3) the concurrent supply of the ink from the main tank 50 to the fill tank 12 and the drain tank 13, (4) the supply of the ink from the main tank 50 to the fill tank 12, (5) the return of the ink from the drain tank 13 to the main tank 50, and (6) the circulation with the main tank, by controlling the opening/ closing of the valves V1 to V5 of HPM 30. The control operations as described above can be executed singly respectively, or the control operations as described above can be also executed continuously by combining the plurality of control operations. The respective ink flow control operations will be explained below.

<First Circulation Process>

Figure 4:
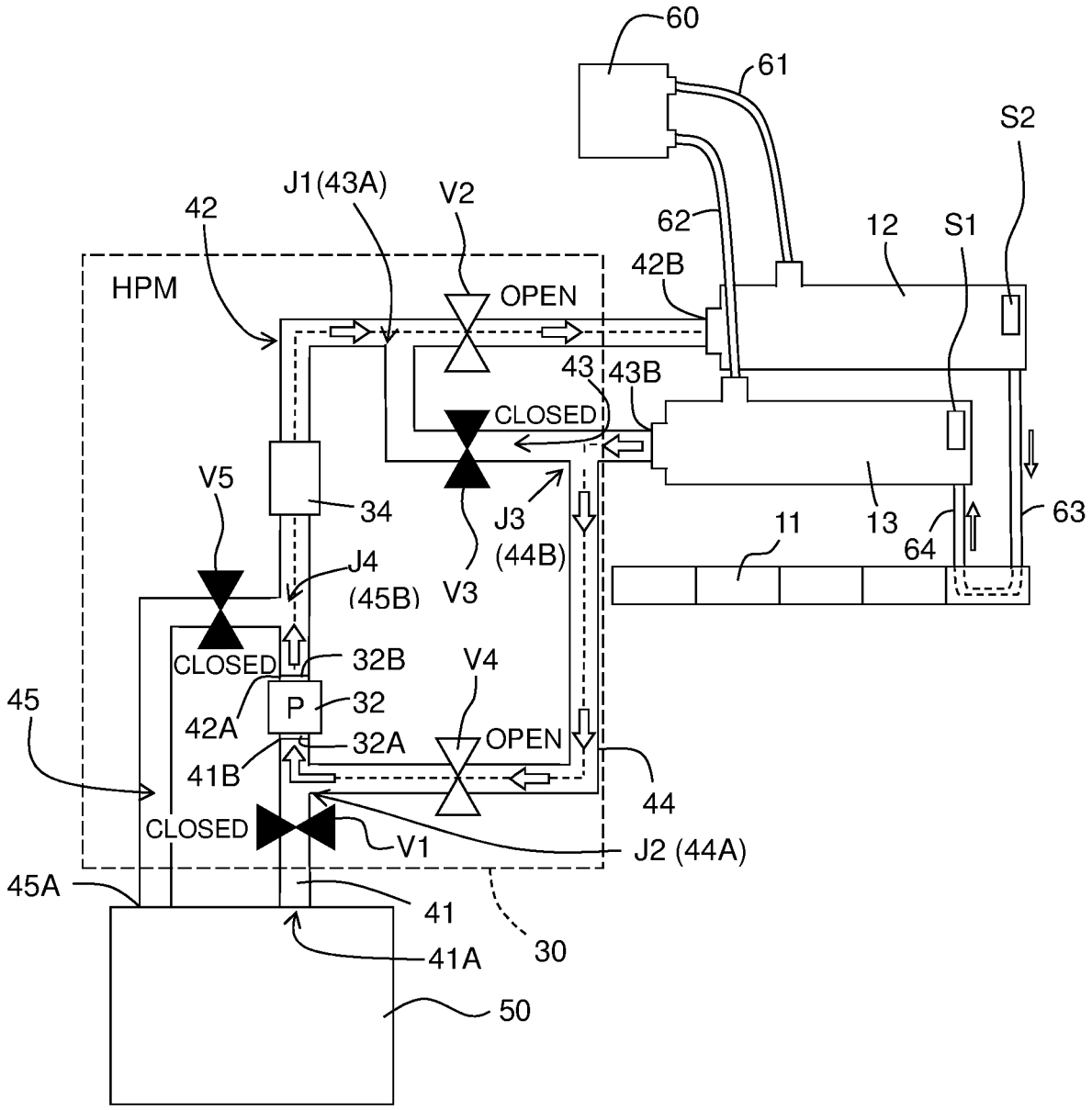
FIG. 4 schematically explains ink flow passages in a first circulation process.

As depicted in FIG. 4, the flow of the ink, which passes from the drain tank 13 through the fourth flow passage 44 and the second flow passage 42 and which is directed to the fill tank 12, can be generated by driving the pump 32 in a state in which the valves V1, V3, V5 are closed and the valves V2, V4 are open. In this specification, the process, in which the ink is circulated from the drain tank 13 to the fill tank 12, is referred to as "first circulation process".

<Drain Tank Supply Process>

Figure 5:
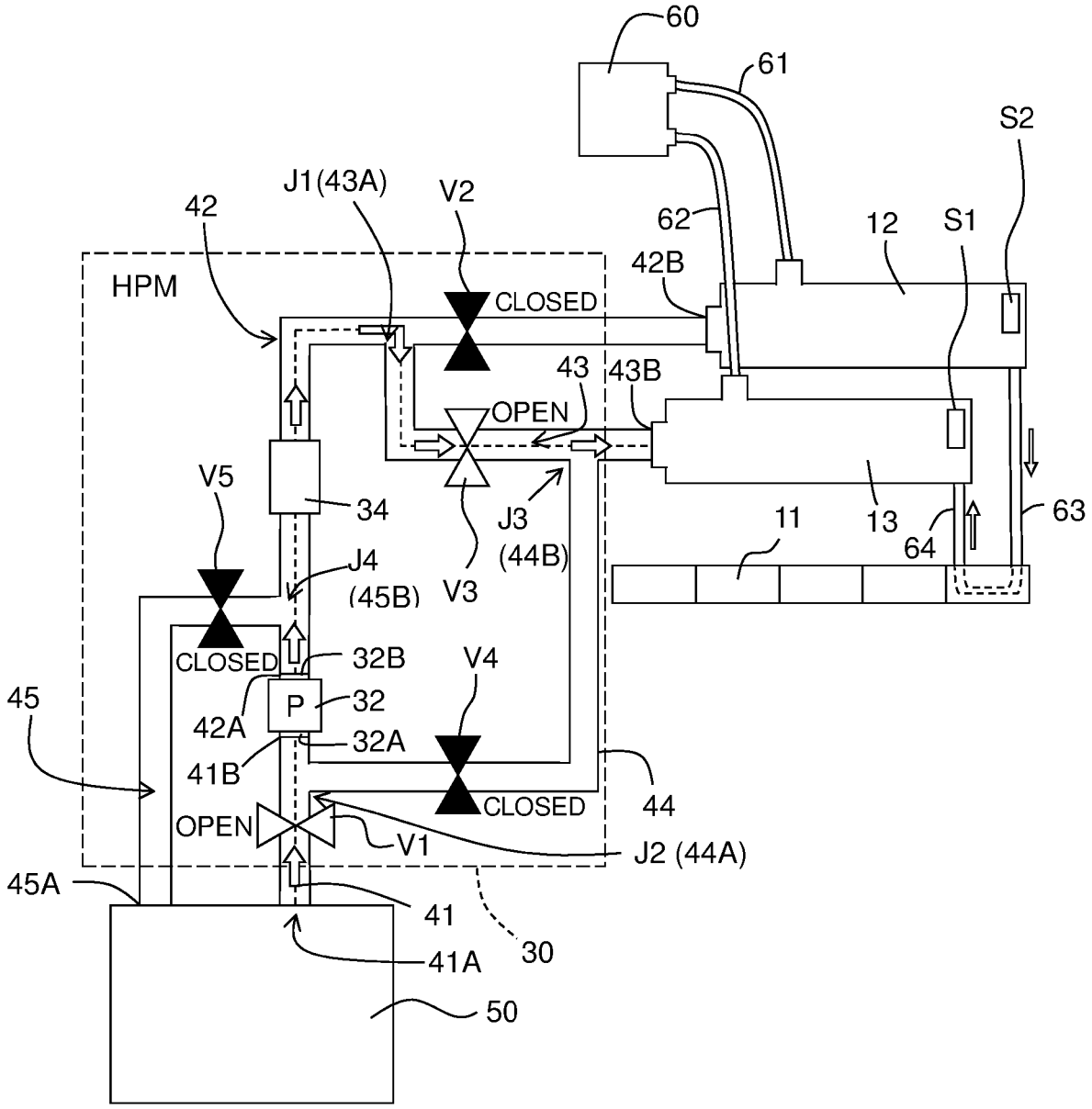
FIG. 5 schematically explains ink flow passages in a drain tank supply process.

As depicted in FIG. 5, the flow of the ink, which passes from the main tank 50 through the first flow passage 41 and the third flow passage 43 and which is directed to the drain tank 13, can be generated by driving the pump 32 in a state in which the valves V2, V4, V5 are closed and the valves V1, V3 are open. Accordingly, the ink contained in the main tank 50 can be supplied to the drain tank 13. In this specification, the process, in which the ink contained in the main tank 50 is supplied to the drain tank 13, is referred to as "drain tank supply process".

<Fill Tank-Drain Tank Concurrent Supply Process>

Figure 6:
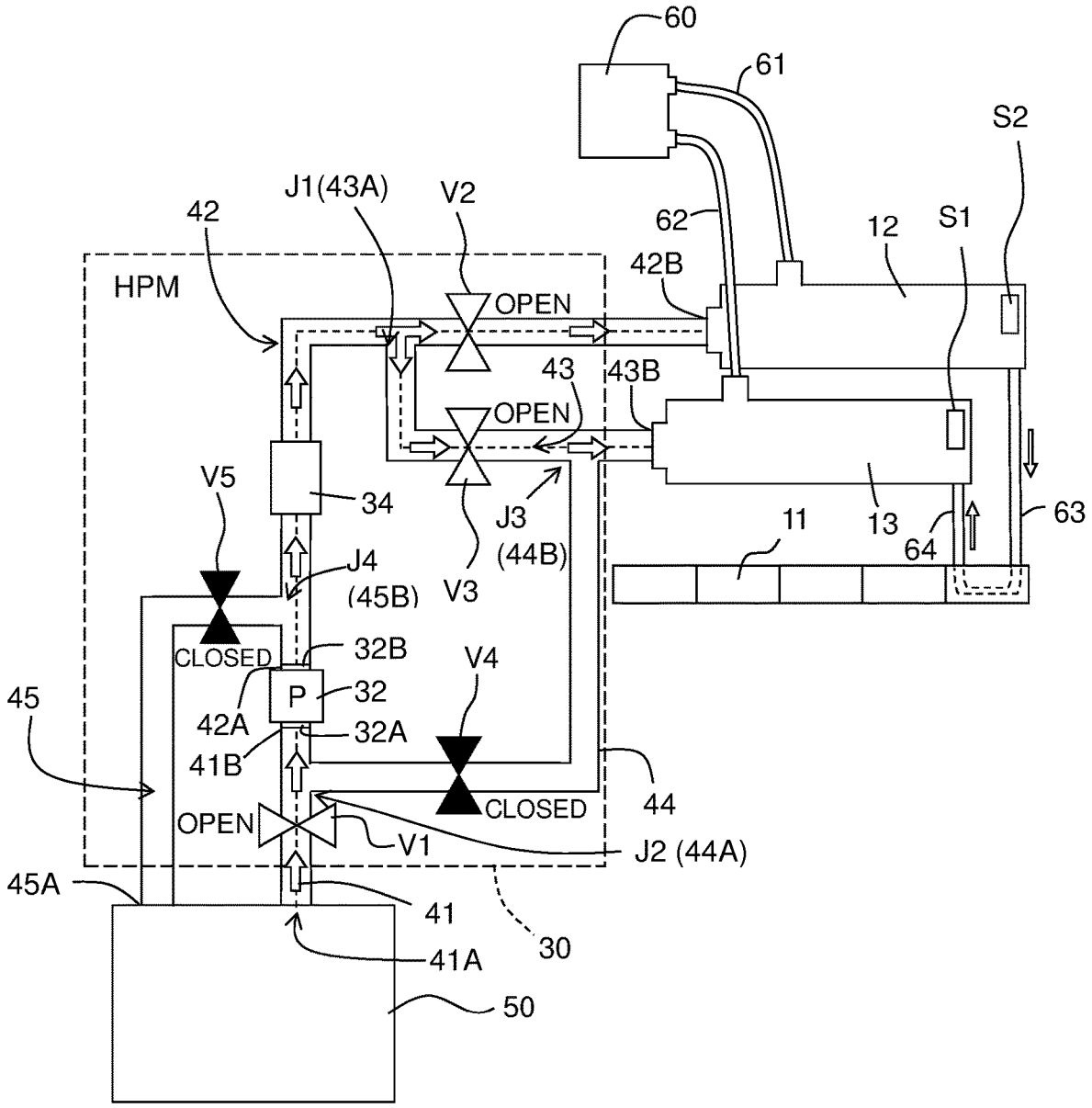
FIG. 6 schematically explains ink flow passages in a fill tank-drain tank concurrent supply process.

As depicted in FIG. 6, the flow of the ink, which passes from the main tank 50 through the first flow passage 41 and the second flow passage 42 and which is directed to the fill tank 12, and the flow of the ink, which passes from the main tank 50 through the first flow passage 41 and the third flow passage 43 and which is directed to the drain tank 13, can be generated by driving the pump 32 in a state in which the valves V4, V5 are closed and the valves V1, V2, V3 are open. Accordingly, the ink contained in the main tank 50 can be concurrently supplied to the fill tank 12 and the drain tank 13. In this specification, the process, in which the ink contained in the main tank 50 is concurrently supplied to the fill tank 12 and the drain tank 13, is referred to as "fill tank-drain tank concurrent supply process".

<Fill Tank Supply Process>

Figure 7:
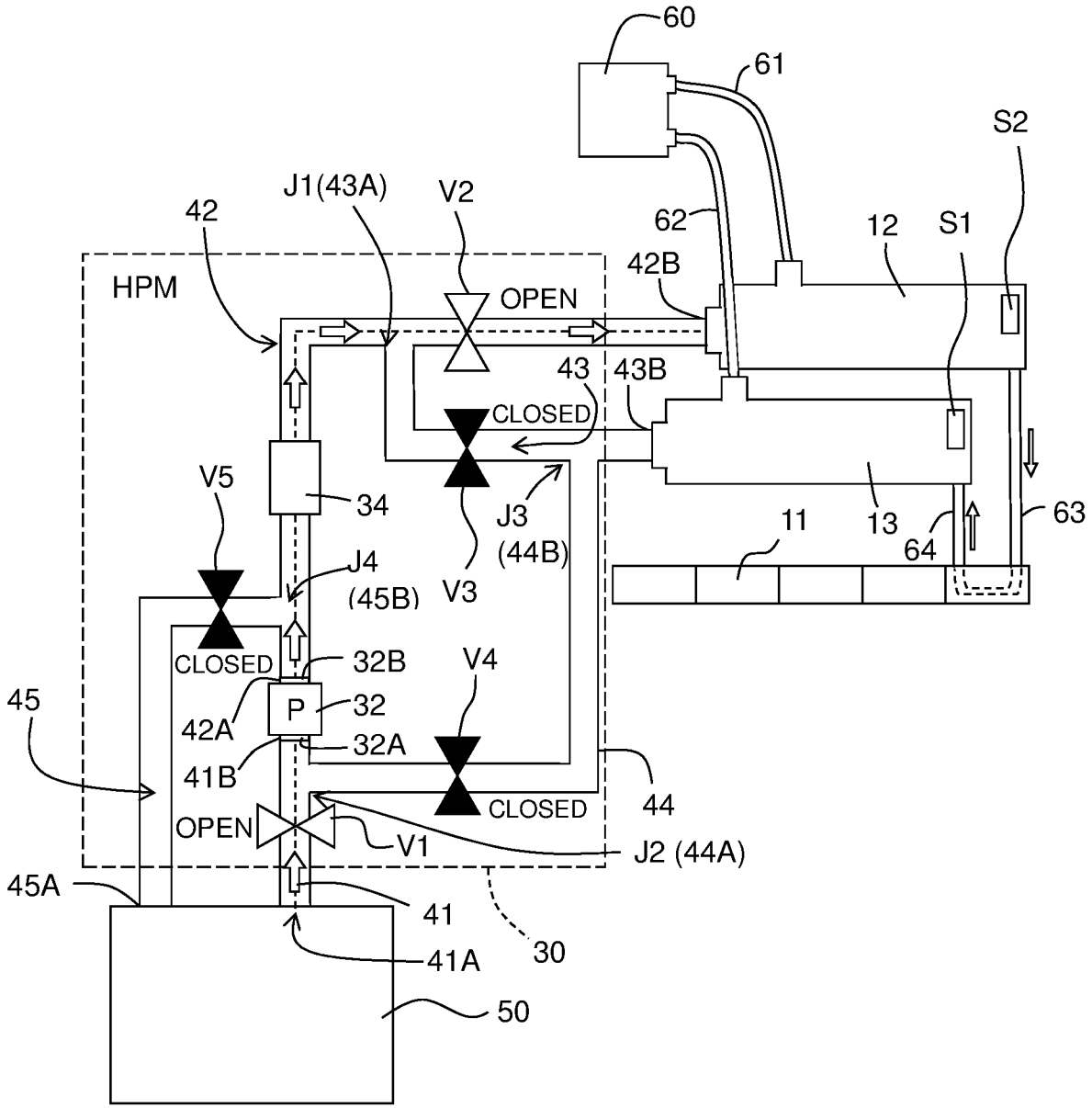
FIG. 7 schematically explains ink flow passages in a fill tank supply process.

As depicted in FIG. 7, the flow of the ink, which passes from the main tank 50 through the first flow passage 41 and the second flow passage 42 and which is directed to the fill tank 12, can be generated by driving the pump 32 in a state in which the valves V3, V4, V5 are closed and the valves V1, V2 are open. Accordingly, the ink contained in the main tank 50 can be supplied to the fill tank 12. In this specification, the process, in which the ink contained in the main tank 50 is supplied to the fill tank 12, is referred to as "fill tank supply process".

<Drain Tank-Main Tank Transport Process>

Figure 8:
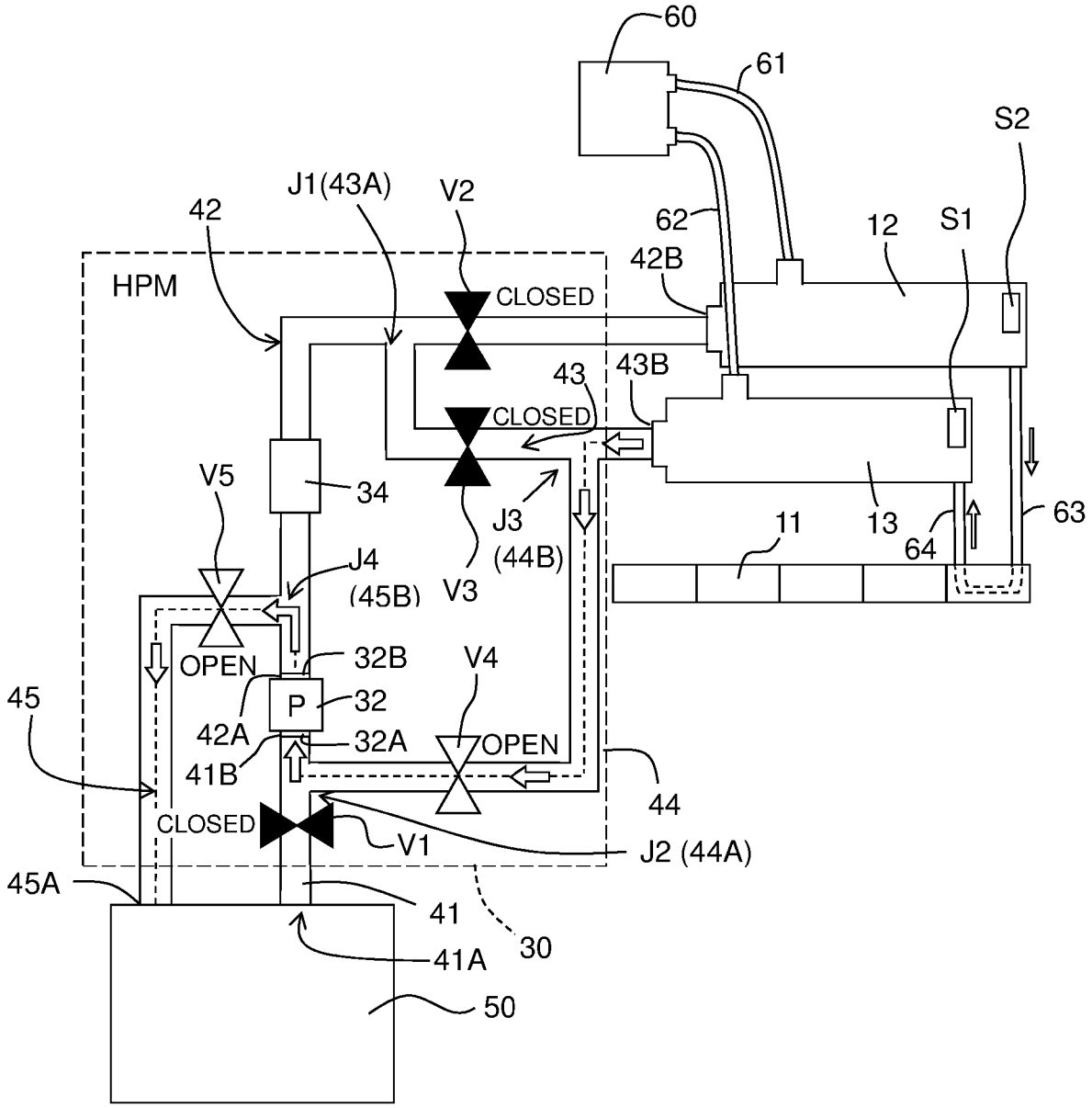
FIG. 8 schematically explains ink flow passages in a drain tank-main tank transport process.

As depicted in FIG. 8, the flow of the ink, which passes from the drain tank 13 through the fourth flow passage 44 and the fifth flow passage 45 and which is directed to the main tank 50, can be generated by driving the pump 32 in a state in which the valves V1, V2, V3 are closed and the valves V4, V5 are open. Accordingly, the ink contained in the drain tank 13 can be returned to the main tank 50. In this specification, the process, in which the ink contained in the drain tank 13 is returned to the main tank 50, is referred to as "drain tank-main tank transport process".

<Second Circulation Process>

Figure 9:
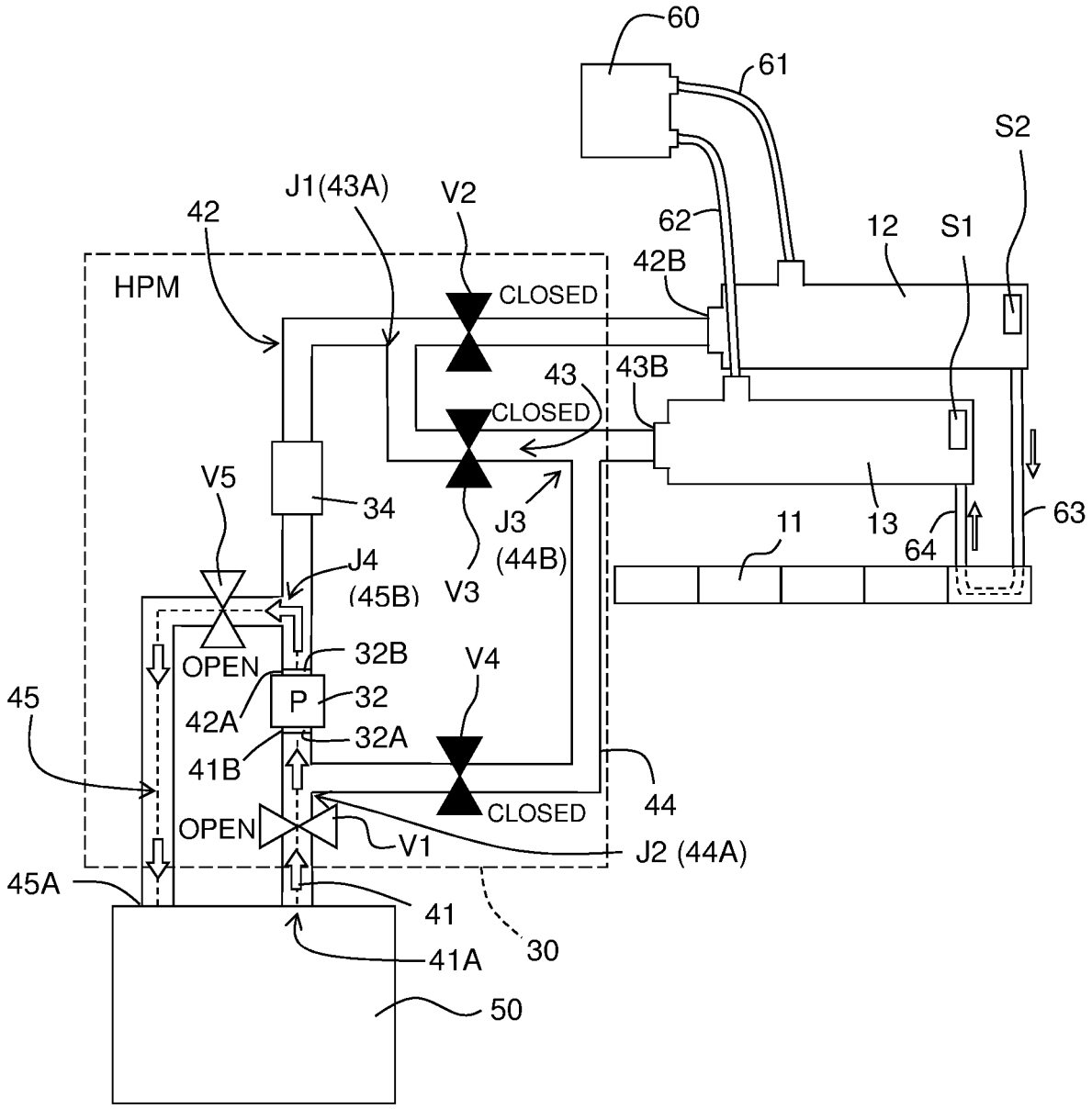
FIG. 9 schematically explains ink flow passages in a second circulation process.

As depicted in FIG. 9, the flow of the ink, which passes from the main tank 50 through the first flow passage 41 and the fifth flow passage 45 and which is returned to the main tank 50, can be generated by driving the pump 32 in a state in which the valves V2, V3, V4 are closed and the valves V1, V5 are open. Accordingly, the ink contained in the main tank 50 can be agitated. In this specification, the process, in which the ink contained in the main tank 50 is returned to the main tank 50, is referred to as "second circulation process".

<Effect of this Embodiment>

The first circulation process described above can be executed, for example, when the printing is not executed. When the controller 7 executes the first circulation process, then the ink can be thereby circulated between the drain tank 13 and the fill tank 12, and the viscosity of the ink can be prevented from being raised in the ink flow passage in which the ink is circulated. Further, the controller 7 can also concurrently execute the differential pressure circulation process described above based on the use of the air pressure regulator 60. Accordingly, for example, when the printing is executed, the ink can be fed from the fill tank 12 toward the head 11. Therefore, it is also possible to respond to the high duty printing (for example, high speed printing or solid printing) in which a large amount of the ink is consumed in a short period of time.

Further, the high duty printing such as the high speed printing, the solid printing or the like is performed in some cases while circulating the ink between the drain tank 13 and the fill tank 12 by concurrently executing the differential pressure circulation process and the first circulation process. In this case, not only the ink which is supplied from the fill tank 12 to the head 11 in accordance with the differential pressure circulation but the ink which is contained in the drain tank 13 is also supplied to the head 11. In accordance therewith, it is considered that the ink amount of the fill tank 12 is lower than a lower limit threshold value (hereinafter simply referred to as "lower limit value"), the ink amount of the drain tank 13 is lower than a lower limit value, and both of the ink amount of the fill tank 12 and the ink amount of the drain tank 13 are lower than the lower limit values.

Note that the drain tank 13 is a tank for recovering and storing a part of the ink supplied from the fill tank 12 to the head 11. Therefore, the ink amount of the drain tank 13 is smaller than the ink amount of the fill tank 12 in many cases. Therefore, when the ink is supplied to the head 11 also from the drain tank 13 in accordance with the high duty printing, it is highly possible that the ink amount of the drain tank 13 may be lower than the lower limit value in a short period of time.

If only the ink amount of the drain tank 13 is lower than the lower limit value, the controller 7 can supply the ink contained in the main tank 50 to the drain tank 13 by executing the drain tank supply process described above. Accordingly, it is possible to secure a sufficient amount of the ink in the drain tank 13. Even the high duty printing (for example, high speed printing or solid printing), which consumes a large amount of the ink in a short period of time, can be reliably executed. Note that the controller 7 can switch the first circulation process to the drain tank supply process in accordance with the fact that the sensor S2 outputs the second output signal which indicates that the ink amount of the drain tank 13 approaches zero when the first circulation process is executed. Further, the controller 7 can interrupt the drain tank supply process in accordance with the fact that the sensor S2 outputs the first output signal which indicates that the ink amount of the drain tank 13 arrives at the full amount. On the other hand, the controller 7 can switch the drain tank supply process to the first circulation process in accordance with the fact that the sensor S2 outputs the first output signal which indicates that the ink amount of the drain tank 13 arrives at the full amount. As described above, the ink contained in the drain tank 13 can be prevented from the overflow or the emptiness by allowing the controller 7 to automatically start or stop the execution of the drain tank supply process in accordance with the first and second output signals of the sensor S2.

Further, if only the ink amount of the fill tank 12 is lower than the lower limit value, the controller 7 can supply the ink contained in the main tank 50 to the fill tank 12 by executing the fill tank supply process described above. Accordingly, it is possible to secure a sufficient ink amount in the fill tank 12. Even the high duty printing (for example, high speed printing or solid printing), which consumes a large amount of the ink in a short period of time, can be reliably executed. Note that the controller 7 can switch the first circulation process to the fill tank supply process in accordance with the fact that the sensor S1 outputs the second output signal which indicates that the ink amount of the fill tank 12 approaches zero when the first circulation process is executed. Further, the controller 7 can interrupt the fill tank supply process in accordance with the fact that the sensor S1 outputs the first output signal which indicates that the ink amount of the fill tank 12 arrives at the full amount. On the other hand, the controller 7 can switch the fill tank supply process to the first circulation process in accordance with the fact that the sensor S1 outputs the first output signal which indicates that the ink amount of the fill tank 12 arrives at the full amount. As described above, the ink contained in the fill tank 12 can be prevented from the overflow or the emptiness by allowing the controller 7 to automatically start or stop the execution of the fill tank supply process in accordance with the first and second output signals of the sensor S1.

Further, if the printing such as the high duty printing or the like is executed as well during the period in which the drain tank supply process described above is executed, not only the ink amount of the drain tank 13 but also the ink amount of the fill tank 12 may be lower than the lower limit value. In such a situation, the controller 7 can switch the drain tank supply process to the fill tank-drain tank concurrent supply process. Similarly, if the printing such as the high duty printing or the like is executed as well during the period in which the fill tank supply process described above is executed, not only the ink amount of the fill tank 12 but also the ink amount of the drain tank 13 may be lower than the lower limit value. In such a situation, the controller 7 can switch the fill tank supply process to the fill tank-drain tank concurrent supply process. In any case, sufficient ink amounts can be secured in both of the fill tank 12 and the drain tank 13. Even the high duty printing (for example, high speed printing or solid printing), which consumes a large amount of the ink in a short period of time, can be reliably executed. Further, the ink can be supplied concurrently to the fill tank 12 and the drain tank 13 in the fill tank-drain tank concurrent supply process. Therefore, the ink can be supplied to the fill tank 12 and the drain tank 13 in a short period of time as compared with a case in which the fill tank supply process and the drain tank supply process are continuously performed.

Note that the controller 7 can switch the drain tank supply process to the fill tank-drain tank concurrent supply process in accordance with the fact that the sensor S1 outputs the second output signal which indicates that the ink amount of the fill tank 12 approaches zero when the drain tank supply process is executed. Similarly, the controller 7 can switch the fill tank supply process to the fill tank-drain tank concurrent supply process in accordance with the fact that the sensor S2 outputs the second output signal which indicates that the ink amount of the drain tank 13 approaches zero when the fill tank supply process is executed.

Further, the controller 7 can interrupt the fill tank-drain tank concurrent supply process in accordance with the fact that the sensor S2 outputs the first output signal which indicates that the ink amount of the drain tank 13 is the full amount or the fact that the sensor S1 outputs the first output signal which indicates that the ink amount of the fill tank 12 is the full amount during the period in which the fill tank-drain tank concurrent supply process is executed. In this situation, the controller 7 may interrupt the fill tank-drain tank concurrent supply process and restart the first circulation process. On the other hand, the controller 7 may switch the fill tank-drain tank concurrent supply process to the fill tank supply process if the ink amount of the fill tank 12 is not the full amount, and the controller 7 may switch the fill tank-drain tank concurrent supply process to the drain tank supply process if the ink amount of the drain tank 13 is not the full amount. In any case, the controller 7 automatically start or stop the execution of the fill tank-drain tank supply process in accordance with the first and second output signals of the sensors S1, S2, and thus the ink contained in the fill tank 12 and the drain tank 13 can be prevented from the overflow or the emptiness. Even the high duty printing can be reliably executed.

When the first circulation process described above is executed, the controller 7 can switch the first circulation process to the drain tank-main tank transport process. For example, if it is judged that the ink amount of the fill tank 12 is sufficiently large, the ink can be transported to the main tank 50 without supplying the ink to the fill tank 12 from the drain tank 13. In this case, the ink contained in the main tank 50 can be agitated by using the ink allowed to return from the drain tank 13. For example, if the ink contained in the main tank 50 is a dye ink, it is scarcely feared that any precipitation may be caused in the ink contained in the main tank 50. However, if the ink contained in the main tank 50 is, for example, an ink such as a pigment ink which easily causes the precipitation, it is possible to suppress the ink contained in the main tank 50 from causing the precipitation, by agitating the ink contained in the main tank 50. Note that even if the ink contained in the main tank 50 is a dye ink, it is possible to suppress the increase in the viscosity of the ink by agitating the ink contained in the main tank 50.

Further, when the second circulation process described above is performed, the ink contained in the main tank 50 can be also agitated by using the ink which outgoes from the main tank 50, which passes through the first flow passage 41 and the fifth flow passage 45, and which returns to the main tank 50. Also in this case, it is possible to suppress the occurrence of the precipitation in the ink contained in the main tank 50 and the increase in the viscosity.

Further, the ink can be circulated through the flow passage including the main tank 50 such as "drain tank 13→main tank 50→drain tank 13→fill tank 12" by executing the drain tank supply process after the drain tank-main tank transport process described above and further executing the first circulation process. Similarly, the ink can be also circulated through the flow passage including the main tank 50 by executing the fill tank-drain tank concurrent supply process after the drain tank-main tank transport process and further executing the first circulation process. Further, the ink can be also circulated through the flow passage including the main tank 50 by executing the fill tank supply process after the drain tank-main tank transport process and further executing the first circulation process. In any case, the ink can be circulated through the flow passage including the main tank 50. Therefore, the ink can be circulated while agitating the ink contained in the main tank 50. Accordingly, it is possible to suppress the occurrence of the precipitation in the ink contained in the main tank 50 and the increase in the viscosity. Further, it is possible to avoid the increase in the viscosity of the ink in the ink flow passage through which the ink is circulated.

The drain tank 13 is a tank for recovering and storing a part of the ink supplied from the fill tank 12 to the head 11. Therefore, the ink amount of the drain tank 13 is smaller than the ink amount of the fill tank 12 in many cases. The ink outflows from the drain tank in the first circulation process and the drain tank-main tank transport process described above. On the contrary, the ink does not outflow from the drain tank in the drain tank supply process, the fill tank-drain tank concurrent supply process, and the fill tank supply process. In this embodiment, the pump 32 is controlled so that the flow velocity of the ink is slow in the first circulation process and the drain tank-main tank transport process as compared with the drain tank supply process, the fill tank-drain tank concurrent supply process, and the fill tank supply process. Accordingly, a situation, in which the ink contained in the drain tank 13 is insufficient, can be suppressed, which would be otherwise caused by quickly withdrawing the ink from the drain tank 13.

The embodiment explained above is depicted by way of example in every sense, which does not limit the invention defined in claims. Further, all of the combinations of the features explained in the foregoing embodiment are not necessarily essential. Further, various modifications can be made for the embodiment described above.

For example, in the embodiment described above, the printer 1 is provided with the four head bars 4, and each of the head bars 4 is provided with the nine heads 11. However, the present invention is not limited to such a form. It is possible to appropriately adjust the number and the arrangement of the ink-jet heads and the head units. Further, the fill tank 12 has approximately the same shape as that of the drain tank 13. However, the present invention is not limited to such a form. It is possible to arbitrarily adjust the size and the shape of the fill tank and the drain tank.

In the embodiment explained above, this teaching is applied to the head bar 4 for printing, for example, an image by discharging the ink onto the recording paper. In the embodiment described above, the head bar 4 is a so-called line type ink-jet head. However, this teaching is not limited thereto, which can be also applied to a so-called serial type ink-jet head. Further, the present invention is not limited to the ink-jet head for discharging the ink. This teaching can be also applied to any liquid discharge apparatus to be used for various ways of use other than the printing of the image or the like. For example, the present invention can be also applied to a liquid discharge apparatus for discharging a conductive liquid to a substrate to form a conductive pattern on a surface of the substrate.

The liquid discharge apparatus according to the present disclosure may further include a controller configured to drive of the pump and open/close of the first to fifth valves. In this case, the controller can control the opening of the first to fifth valves, closing of the first to fifth valves and the driving of the pump, and hence it is unnecessary for a user to manually perform the opening/closing of the valves and the driving of the pump.

In the liquid discharge apparatus according to the present disclosure, the controller may be configured to execute a first circulation process including closing the first valve, the third valve, and the fifth valve; opening the second valve and the fourth valve; and driving the pump.

In this case, the liquid can be circulated or transported between the drain tank and the fill tank so that the liquid, which outgoes from the drain tank, passes through the fourth flow passage and the second flow passage and enters the fill tank. The ink can be circulated between the drain tank and the fill tank by executing the first circulation process, for example, when the printing is not executed. It is possible to prevent the viscosity of the ink from being raised in the drain tank and the fill tank.

The liquid discharge apparatus according to the present disclosure may further include a pressure regulator connected to the fill tank and the drain tank and configured to regulate an air pressure in the fill tank and an air pressure in the drain tank, wherein the controller is configured to execute a differential pressure circulation process for controlling the pressure adjusting mechanism so that the air pressure in the fill tank is higher than the air pressure in the drain tank.

In this case, the liquid can be fed from the fill tank toward the liquid discharge head, for example, even when the liquid discharge head discharges the liquid. Therefore, it is also possible to respond to such a situation that the liquid discharge head discharges a large amount of the liquid in a short period of time (for example, the high duty printing in which a large amount of the ink is consumed in a short period of time).

Note that the controller may be configured to execute a drain tank supply process including: closing the second valve, the fourth valve, and the fifth valve; opening the first valve and the third valve; and driving the pump.

When the liquid discharge head discharges a large amount of the liquid in a short period of time, the liquid is supplied to the liquid discharge head not only from the fill tank but also from the drain tank. In accordance therewith, it is feared that the liquid contained in the drain tank may be decreased, and the liquid cannot be supplied from the drain tank to the liquid discharge head. On the contrary, according to the configuration described above, the liquid can be supplied from the main tank to the drain tank. Accordingly, even when the liquid discharge head discharges the liquid in the large amount in the short period of time, the liquid can be stably supplied from the drain tank to the liquid discharge head.

In the liquid discharge apparatus according to the present disclosure, the controller may be configured to execute a fill tank-drain tank concurrent supply process including: closing the fourth valve and the fifth valve; opening the first valve, the second valve and the third valve; and driving the pump.

When the liquid discharge head discharges a large amount of the liquid in a short period of time, not only the liquid contained in the drain tank but also the liquid contained in the fill tank is decreased. Therefore, both of the tanks cannot supply a sufficient amount of the liquid to the liquid discharge head in some cases. However, according to the configuration described above, the liquid can be supplied concurrently or simultaneously from the main tank to both of the fill tank and the drain tank. Accordingly, even when the liquid discharge head discharges a large amount of the liquid in a short period of time, the liquid can be stably supplied to the liquid discharge head from the drain tank and the fill tank. Further, according to the configuration described above, the liquid can be concurrently supplied to the fill tank and the drain tank. Therefore, the ink can be supplied to both of the fill tank and the drain tank in a short period of time as compared with a case in which the process for supplying the liquid from the main tank to the fill tank and the process for supplying the liquid from the main tank to the drain tank are continuously performed.

In the liquid discharge apparatus according to the present disclosure, the controller may be configured to execute a fill tank supply process including: closing the third valve, the fourth valve, and the fifth valve; opening the first valve and the second valve; and driving the pump.

When the liquid discharge head discharges a large amount of the liquid in a short period of time, then the liquid contained in the fill tank is decreased, and the liquid cannot be supplied from the fill tank to the liquid discharge head in some cases. On the contrary, according to the configuration described above, the liquid can be supplied from the main tank to the fill tank. Accordingly, even when the liquid discharge head discharges a large amount of the liquid in a short period of time, the liquid can be stably supplied from the fill tank to the liquid discharge head.

In the liquid discharge apparatus according to the present disclosure, the controller may be configured to further execute a drain tank-main tank transport process including: closing the first valve, the second valve, and the third valve; opening the fourth valve and the fifth valve; and driving the pump.

In this case, the liquid, which returns from the drain tank, can be used to agitate the liquid contained in the main tank. Accordingly, for example, when the liquid contained in the main tank is a liquid such as a pigment ink which easily causes the precipitation, it is possible to suppress the occurrence of the precipitation in the liquid contained in the main tank by agitating the liquid contained in the main tank.

In the liquid discharge apparatus according to the present disclosure, the controller may be configured to execute a drain tank supply process including: closing the second valve, the fourth valve, and the fifth valve; opening the first valve and the third valve; and driving the pump; and the controller may be configured to execute the first circulation process after executing the drain tank supply process.

Alternatively, the controller may be configured to execute a fill tank-drain tank concurrent supply process including: closing the fourth valve and the fifth valve; opening the first valve, the second valve, and the third valve; and driving the pump; and the controller may be configured to execute the first circulation process after executing the fill tank-drain tank concurrent supply process.

Alternatively, the controller may be configured to execute a fill tank supply process including: closing the third valve, the fourth valve, and the fifth valve; opening the first valve and the second valve; and driving the pump; and the controller may be configured to execute the first circulation process after executing the fill tank supply process.

In any cases, the ink can be circulated not only between the fill tank and the drain tank but also in the flow passage including the main tank. Accordingly, the ink can be circulated between the fill tank and the drain tank while agitating the liquid contained in the main tank. Accordingly, for example, when the liquid contained in the main tank is a pigment ink which easily causes the precipitation, it is possible to avoid the increase in the viscosity of the pigment ink in the flow passage in which the pigment ink is circulated, while suppressing the occurrence of the precipitation in the main tank by agitating the pigment ink contained in the main tank.

The liquid discharge apparatus according to the present disclosure may further include: a liquid amount sensor which detects that an amount of the liquid contained in the drain tank is not more than a threshold value. The controller may be configured to execute the drain tank supply process in accordance with the detection performed by the liquid amount sensor to detect that the amount of the liquid contained in the drain tank is not more than the threshold value.

Alternatively, the liquid discharge apparatus according to the present disclosure may further include: a first liquid amount sensor which detects that an amount of the liquid contained in the fill tank is not more than a first threshold value; and a second liquid amount sensor which detects that an amount of the liquid contained in the drain tank is not more than a second threshold value. The controller may be configured to execute the fill tank-drain tank concurrent supply process in accordance with the detection performed by the first liquid amount sensor to detect that the amount of the liquid contained in the fill tank is not more than the first threshold value and the detection performed by the second liquid amount sensor to detect that the amount of the liquid contained in the drain tank is not more than the second threshold value.

Alternatively, the liquid discharge apparatus according to the present disclosure may further include: a liquid amount sensor which detects that an amount of the liquid contained in the fill tank is not more than a threshold value. The controller may be configured to execute the fill tank supply process in accordance with the detection performed by the liquid amount sensor to detect that the amount of the liquid contained in the fill tank is not more than the threshold value.

In any cases, the controller can automatically start or stop the execution of the fill tank-drain tank supply process, the fill tank supply process, and the drain tank supply process in accordance with the output of the liquid amount sensor. Accordingly, it is possible to avoid the overflow or the emptiness of the liquid contained in the fill tank and the drain tank.

In the liquid discharge apparatus according to the present disclosure, the controller may be configured to further execute a second circulation process including: closing the second valve, the third valve, and the fourth valve; opening the first valve and the fifth valve; and driving the pump.

In this case, the liquid contained in the main tank can be agitated by using the liquid which outgoes from the main tank and which passes through the first flow passage and the fifth flow passage to return to the main tank. Accordingly, for example, when the liquid contained in the main tank is a pigment ink which easily causes the precipitation, it is possible to suppress the occurrence of the precipitation in the main tank by agitating the pigment ink contained in the main tank.

In the liquid discharge apparatus according to the present disclosure, the controller may be configured to further execute: a drain tank supply process; a fill tank-drain tank concurrent supply process; a fill tank supply process; and a drain tank-main tank transport process. The drain tank supply process includes: closing the second valve, the fourth valve, and the fifth valve; opening the first valve and the third valve; and driving the pump. The fill tank-drain tank concurrent supply process includes: closing the fourth valve and the fifth valve; opening the first valve, the second valve, and the third valve; and driving the pump. The fill tank supply process includes: closing the third valve, the fourth valve, and the fifth valve; opening the first valve and the second valve; and driving the pump. The drain tank-main tank transport process includes: closing the first valve, the second valve, and the third valve; opening the fourth valve and the fifth valve; and driving the pump. The controller may control the pump so that a flow velocity of the liquid is slowed down when the first circulation process and the drain tank-main tank transport process are executed as compared with when the drain tank supply process, the fill tank-drain tank concurrent supply process, and the fill tank supply process are executed.

The drain tank is a tank for recovering and storing a part of the liquid supplied from the fill tank to the liquid discharge head. Therefore, the liquid amount of the drain tank is smaller than the liquid amount of the fill tank in many cases. In the configuration described above, the pump is controlled so that the flow velocity of the liquid is slow in the process for drawing the liquid from the drain tank as compared with the other processes. Accordingly, it is possible to suppress such a situation that the liquid contained in the drain tank is insufficient on account of the quick drawing of the liquid from the drain tank.

The liquid discharge apparatus according to the present disclosure can execute (1) the supply of the liquid from the main tank to the drain tank, (2) the supply of the liquid from the main tank to the fill tank, (3) the concurrent supply of the liquid from the main tank to the drain tank and the fill tank, (4) the transport of the liquid from the drain tank to the fill tank, (5) the transport of the liquid from the drain tank to the main tank, and (6) the circulation of the liquid so that the liquid allowed to outgo from the main tank is returned to the main tank again, by using one pump. These six processes can be executed singly or in combination. Accordingly, the liquid can be supplied from the main tank singly or concurrently to both of the drain tank and the fill tank by using one pump. Further, it is possible to switch the circulation of the ink between the fill tank and the drain tank without allowing the ink to pass through the main tank and the circulation of the ink in the flow passage including the main tank as well without being limited to the circulation between the fill tank and the drain tank.

According to an aspect of the present disclosure, there is provided a method for discharging liquid from a liquid discharging apparatus. The liquid discharge apparatus includes: a head unit including: at least one liquid discharge head; a fill tank configured to store the liquid to be supplied to the at least one liquid discharge head; and a drain tank configured to store the liquid recovered from the at least one liquid discharge head. The liquid discharge apparatus further includes: a main tank configured to store the liquid to be supplied to the head unit; a pump including an inlet and an outlet and configured to feed the liquid from the inlet to the outlet; a first flow passage including a first end connected to the main tank and a second end connected to the inlet of the pump; a second flow passage including a first end connected to the outlet of the pump and a second end connected to the fill tank; a third flow passage including a first end connected to a first branch point as a branch point for branching the second flow passage and a second end connected to the drain tank; a fourth flow passage including a first end connected to a second branch point as a branch point for branching the first flow passage and a second end connected to a third branch point as a branch point for branching the third flow passage; a fifth flow passage including a first end connected to the main tank and a second end connected to a fourth branch point as a branch point for branching the second flow passage between the first end of the second flow passage and the first branch point; a first valve arranged at a portion of the first flow passage disposed between the first end of the first flow passage and the second branch point; a second valve arranged at a portion of the second flow passage disposed between the first branch point and the second end of the second flow passage; a third valve arranged at a portion of the third flow passage disposed between the first end of the third flow passage and the third branch point; a fourth valve arranged at a portion of the fourth flow passage disposed between the first end of the fourth flow passage and the second end of the fourth flow passage; and a fifth valve arranged at a portion of the fifth flow passage disposed between the first end of the fifth flow passage and the second end of the fifth flow passage. The method includes: closing the first valve, the third valve, and the fifth valve; opening the second valve and the fourth valve; and driving the pump.

What is claimed is:

1. A liquid discharge apparatus configured to discharge a liquid onto a medium, comprising:

a head unit including: at least one liquid discharge head; a fill tank configured to store the liquid to be supplied to the at least one liquid discharge head; and a drain tank configured to store the liquid recovered from the at least one liquid discharge head;

a main tank configured to store the liquid to be supplied to the head unit;

a pump including an inlet and an outlet and configured to feed the liquid from the inlet to the outlet;

a first flow passage including a first end connected to the main tank and a second end connected to the inlet of the pump;

a second flow passage including a first end connected to the outlet of the pump and a second end connected to the fill tank;

a third flow passage including a first end connected to a first branch point as a branch point for branching the second flow passage and a second end connected to the drain tank;

a fourth flow passage including a first end connected to a second branch point as a branch point for branching the first flow passage and a second end connected to a third branch point as a branch point for branching the third flow passage;

a fifth flow passage including a first end connected to the main tank and a second end connected to a fourth branch point as a branch point for branching the second flow passage between the first end of the second flow passage and the first branch point;

a first valve arranged at a portion of the first flow passage disposed between the first end of the first flow passage and the second branch point;

a second valve arranged at a portion of the second flow passage disposed between the first branch point and the second end of the second flow passage;

a third valve arranged at a portion of the third flow passage disposed between the first end of the third flow passage and the third branch point;

a fourth valve arranged at a portion of the fourth flow passage disposed between the first end of the fourth flow passage and the second end of the fourth flow passage; and a fifth valve arranged at a portion of the fifth flow passage disposed between the first end of the fifth flow passage and the second end of the fifth flow passage.

2. The liquid discharge apparatus according to claim 1, further comprising a controller configured to control driving of the pump, open the first to fifth valves and close the first to fifth valves.

3. The liquid discharge apparatus according to claim 2, wherein the controller is configured to execute a first circulation process including:

closing the first valve, the third valve, and the fifth valve;
opening the second valve and the fourth valve; and
driving the pump.

4. The liquid discharge apparatus according to claim 2, further comprising:

a pressure regulator connected to the fill tank and the drain tank and configured to regulate an air pressure in the fill tank and an air pressure in the drain tank, wherein the controller is configured to execute a differential pressure circulation process for controlling the pressure regulator so that the air pressure in the fill tank is higher than the air pressure in the drain tank.

5. The liquid discharge apparatus according to claim 4, wherein the controller is configured to execute a drain tank supply process including:

closing the second valve, the fourth valve, and the fifth valve;
opening the first valve and the third valve; and
driving the pump.

6. The liquid discharge apparatus according to claim 4, wherein the controller is configured to execute a liquid supply drain tank concurrent supply process including:

closing the fourth valve and the fifth valve;
opening the first valve, the second valve and the third valve; and
driving the pump.

7. The liquid discharge apparatus according to claim 4, wherein the controller is configured to execute a fill tank supply process including:

closing the third valve, the fourth valve, and the fifth valve;
opening the first valve and the second valve; and
driving the pump.

8. The liquid discharge apparatus according to claim 3, wherein the controller is configured to further execute a drain tank-main tank transport process including:

closing the first valve, the second valve, and the third valve;
opening the fourth valve and the fifth valve; and
driving the pump.

9. The liquid discharge apparatus according to claim 8, wherein the controller is configured to execute a drain tank supply process including:

closing the second valve, the fourth valve, and the fifth valve;
opening the first valve and the third valve; and
driving the pump and wherein the controller is configured to execute the first circulation process after executing the drain tank supply process.

10. The liquid discharge apparatus according to claim 5, further comprising:

a liquid amount sensor configured to detect that an amount of the liquid stored in the drain tank is not more than a threshold value, wherein the controller is configured to execute the drain tank supply process in accordance with the detection performed by the liquid amount sensor to detect that the amount of the liquid contained in the drain tank is not more than the threshold value.

11. The liquid discharge apparatus according to claim 8, wherein the controller is configured to execute a fill tank-drain tank concurrent supply process including:

closing the fourth valve and the fifth valve;
opening the first valve, the second valve, and the third valve; and
driving the pump, and wherein the controller is configured to execute the first circulation process after executing the fill tank-drain tank concurrent supply process.

12. The liquid discharge apparatus according to claim 11, further comprising:

a first liquid amount sensor configured to detect that an amount of the liquid contained in the fill tank is not more than a first threshold value; and a second liquid amount sensor configured to detect an amount of the liquid contained in the drain tank is not more than a second threshold value, wherein the controller is configured to execute the fill tank-drain tank concurrent supply process in accordance with the detection performed by the first liquid amount sensor to detect that the amount of the liquid contained in the fill tank is not more than the first threshold value and the detection performed by the second liquid amount sensor to detect that the amount of the liquid contained in the drain tank is not more than the second threshold value.

13. The liquid discharge apparatus according to claim 8, wherein the controller is configured to execute a fill tank supply process including:

closing the third valve, the fourth valve, and the fifth valve;
opening the first valve and the second valve; and
driving the pump, and wherein the controller is configured to execute the first circulation process after executing the fill tank supply process.

14. The liquid discharge apparatus according to claim 7, further comprising:

a liquid amount sensor configured to detect that an amount of the liquid contained in the fill tank is not more than a threshold value, wherein the controller is configured to execute the fill tank supply process in accordance with the detection performed by the liquid amount sensor to detect that the amount of the liquid contained in the fill tank is not more than the threshold value.

15. The liquid discharge apparatus according to claim 3, wherein the controller is configured to further execute a second circulation process including:

closing the second valve, the third valve, and the fourth valve;
opening the first valve and the fifth valve; and
driving the pump.

16. The liquid discharge apparatus according to claim 3, wherein the controller is configured to further execute:

a drain tank supply process including:
closing the second valve, the fourth valve, and the fifth valve;
opening the first valve and the third valve; and
driving the pump;

a fill tank-drain tank concurrent supply process including:
closing the fourth valve and the fifth valve;
opening the first valve, the second valve, and the third valve; and
driving the pump;

a fill tank supply process including:
closing the third valve, the fourth valve, and the fifth valve;
opening the first valve and the second valve; and
driving the pump; and a drain tank-main tank transport process including:
closing the first valve, the second valve, and the third valve;

opening the fourth valve and the fifth valve; and driving the pump, and wherein the controller controls the pump so that a flow velocity of the liquid is slowed down when the first circulation process and the drain tank-main tank transport process are executed as compared with when the drain tank supply process, the fill tank-drain tank concurrent supply process, and the fill tank supply process are executed.

17. A method for discharging liquid from a liquid discharge apparatus, the liquid discharge apparatus including:

a head unit including: at least one liquid discharge head; a fill tank configured to store the liquid to be supplied to the at least one liquid discharge head; and a drain tank configured to store the liquid recovered from the at least one liquid discharge head;

a main tank configured to store the liquid to be supplied to the head unit;

a pump including an inlet and an outlet and configured to feed the liquid from the inlet to the outlet;

a first flow passage including a first end connected to the main tank and a second end connected to the inlet of the pump;

a second flow passage including a first end connected to the outlet of the pump and a second end connected to the fill tank;

a third flow passage including a first end connected to a first branch point as a branch point for branching the second flow passage and a second end connected to the drain tank;

a fourth flow passage including a first end connected to a second branch point as a branch point for branching the first flow passage and a second end connected to a third branch point as a branch point for branching the third flow passage;

a fifth flow passage including a first end connected to the main tank and a second end connected to a fourth branch point as a branch point for branching the second flow passage between the first end of the second flow passage and the first branch point;

a first valve arranged at a portion of the first flow passage disposed between the first end of the first flow passage and the second branch point;

a second valve arranged at a portion of the second flow passage disposed between the first branch point and the second end of the second flow passage;

a third valve arranged at a portion of the third flow passage disposed between the first end of the third flow passage and the third branch point;

a fourth valve arranged at a portion of the fourth flow passage disposed between the first end of the fourth flow passage and the second end of the fourth flow passage; and a fifth valve arranged at a portion of the fifth flow passage disposed between the first end of the fifth flow passage and the second end of the fifth flow passage, the method comprising:

closing the first valve, the third valve, and the fifth valve;

opening the second valve and the fourth valve; and driving the pump.

* * * * *